United States Patent [19]

Burwell

[11] 4,392,529

[45] Jul. 12, 1983

[54] METHOD OF CLEANING A WELL AND APPARATUS THEREOF

[76] Inventor: Maurel R. Burwell, 4877 Arbor St., SW., Canton, Ohio 44710

[21] Appl. No.: 317,750

[22] Filed: Nov. 3, 1981

[51] Int. Cl.[3] ..... E21B 37/00

[52] U.S. Cl. ..... 166/255; 166/311; 166/53

[58] Field of Search ..... 166/311, 312, 305 R-308, 166/255, 244 C, 68.5, 53, 64; 134/22.12; 417/118, 430, 148

[56] References Cited

U.S. PATENT DOCUMENTS

| | | | |
|---|---|---|---|
| 657,951 | 9/1900 | Mooney . | |
| 1,774,640 | 9/1930 | Dunn . | |
| 1,999,146 | 4/1935 | Ambrose et al. | 166/21 |
| 2,120,132 | 6/1938 | Hawkins | 255/24 |
| 2,354,570 | 7/1944 | Benckenstein | 166/21 |
| 2,768,694 | 10/1956 | Moll et al. | 166/43 |
| 2,811,209 | 10/1957 | Elkins | 166/311 |
| 2,907,390 | 10/1959 | Moll et al. | 166/312 X |
| 3,019,839 | 2/1962 | Bloom | 166/43 |
| 3,561,534 | 2/1971 | Dendy | 166/311 |
| 3,899,027 | 8/1975 | Jenkins | 166/68.5 X |

*Primary Examiner*—Ernest R. Purser
*Assistant Examiner*—Thuy M. Bui
*Attorney, Agent, or Firm*—Oldham, Oldham, Hudak, Weber & Sand Co.

[57] ABSTRACT

An improved method for cleaning a water well by creating a pulsating action at the lower inlet end of the well casing. The well casing is sealed to form a generally airtight enclosure. A water level sensing probe is placed within and extends generally throughout the casing. A vacuum is formed in the well casing by pumping the air therefrom which raises the water column within the casing to a predetermined height. The water level sensing probe signals the height of the water column as it rises within the casing. The vacuum is destroyed upon the water column reaching a predetermined height and the weight of the descending water column forces the water outwardly through the casing openings and into the surrounding strata. The raising and lowering of the water column by creating and destroying a vacuum is repeated, causing an incoming and outgoing surging action of water at the lower end of the casing to remove material blocking the inlet openings and to rearrange the bed of gravel and sand surrounding the openings. The apparatus for carrying out the cleaning operation is relatively lightweight and portable and includes an electrical vacuum-producing pump, an electrical water level sensing probe and indicating lights for the probe, and a dc voltage system for the probe and for applying an electrical charge to the casing to assist in the destruction of the encrustations at the bottom of the casing by creating an electrolytic action.

18 Claims, 8 Drawing Figures

METHOD OF CLEANING A WELL AND APPARATUS THEREOF

BACKGROUND OF THE INVENTION

1. Field of the Invention

The invention relates to wells and particularly to water wells, and to an improved method of cleaning water wells and the apparatus used therefor. More particularly, the invention relates to a method which produces a pulsating action at the lower end of the well casing to unblock the inlet openings of the well casing and for rejuvenating the surrounding strata by the repetitious creation and destruction of a vacuum in the well casing which raises and discharges a column of water therein.

2. Description of the Prior Art

Usual water well systems consist of a well casing which is formed of a plurality of interconnected lengths of pipe which are placed in a bore hole and extend into the ground and terminate in the water-bearing strata a certain distance below the ground level. The bottom section of the wall casing is provided with a screen, perforated section of pipe or other structure having a plurality of holes through which the water from the surrounding strata flows into the well casing to create a water pool therein. A submersible pump may be located in the bottom of the well and attached to a delivery tube which extends upwardly therefrom toward the surface for removing the water therefrom. Alternately, a pump may be located on the surface above the well for drawing water upwardly through the delivery tube from the water pool in the lower end of the casing.

A bed of gravel and sand is formed about the inlet end of the well casing and filters the water as it flows into the casing and also prevents the flow of foreign materials and other objects through the holes and into the well casing. Over a prolonged period of time, these inlet openings become partially blocked by smaller particles of silt, sand and gravel, and become coated with encrustations formed by the various minerals present in most water-bearing strata. This blockage of the inlet holes will reduce the rate of flow of water into the well casing and, correspondingly, the amount and rate of water flow that can be obtained therefrom at a house or building on the ground surface. Likewise, the strata become clogged in the area which surrounds the casing inlet end, further reducing the flow of water into the well casing for subsequent delivery to the upper ground level.

Various devices and equipment have been devised to rejuvenate or clean a well by unblocking the inlet openings and by regenerating the surrounding strata to increase the flow rate of water into the well casing. For example, various types of cleaning systems apply a high pressure on the water in the well casing by a pump which forces the water outwardly through the inlet openings at the lower end of the well and into the surrounding strata to unblock and rejuvenate the same. Examples of such positive pressure well cleaning systems are shown in U.S. Pat. Nos. 647,951, 1,576,538, 1,642,245, 1,774,640, 2,120,132 and 2,768,694.

Other cleaning systems use mechanical devices placed within the well casing to create a sudden surge of liquid pressure outwardly through the screen such as by a piston or plunger, as shown in U.S. Pat. No. 1,488,662. Other systems lower bailers or other receptacles into the bottom of the well for scraping the inside of the casing for removing trapped particles, such as shown in U.S. Pat. No. 1,597,180. Still other systems apply an unblocking pressure by means of frozen carbon dioxide particles which are dropped into the well and upon transformation increase the pressure in the well, forcing the trapped water out through the openings and into the surrounding strata to clean and rejuvenate the same. Examples of these dry ice cleaning methods are shown in U.S. Pat. Nos. 1,843,002 and 2,811,209.

Also, in other well cleaning systems, various chemicals are placed in the well casing for reacting with the strata and encrustations on the inlet pipe section for dissolving the mineral deposits, such as shown in U.S. Pat. Nos. 1,999,146 and 2,850,098. Still other well cleaning systems develop a pulsating action at the inlet end of the casing by applying and removing a positive pressure to the well for pumping the water outwardly and inwardly through the openings for unclogging the same and for rejuvenating the surrounding strata, such as shown in U.S. Pat. Nos. 2,354,570, 2,768,694 and 2,907,390.

Although some of the particular methods and apparatus known in the art may be satisfactory for cleaning and rejuvenating a well, they have one main disadvantage and drawback. Most of these systems require expensive and cumbersome equipment which must be placed into and extend throughout the length of the well after the well delivery tube and pump have been removed therefrom. The removal of the existing delivery tube and/or pump from a well is time consuming and expensive, as is the placement of special equipment into the well which is required for cleaning and rejuvenating the well. Also, these prior art methods require large pumps and power supplies for creating the desired amount of pressure for forcing the water outwardly through the screen openings and into the surrounding strata.

Thus, the need has existed for a well cleaning method and apparatus which does not require the removal of the existing water delivery tube and submersible pump from withoin the well casing, and in which the cleaning is accomplished with relatively lightweight, inexpensive, and portable equipment. There is no known system and apparatus of which I am aware which accomplishes these results other than my particular invention which is described and set forth more fully below.

SUMMARY OF THE INVENTION

Objectives of the invention include providing an improved method of cleaning wells and primarily for cleaning water wells by unblocking the inlet openings at the bottom of the well casing and by rearranging the gravel and sand formation about the casing openings, and in which the surrounding strata also is rejuvenated by causing a pulsating action at the bottom of the well by creating a vacuum within the well casing which raises the level of the water column, whereby upon destruction of the vacuum the weight of the water column moving downwardly forces the water outwardly through the inlet openings and into the surrounding strata. Another objective of the invention is to provide such a method and apparatus in which water level sensor means is placed in the well casing which provides a visible indication to the equipment operator of the height of the water column in the casing to enable the operator to determine the progress of rejuvenation by the length of time required for the water level to move upwardly and downwardly within the casing after the creation and destruction of the vacuum during each cycle of operation.

Still another objective is to provide such a well cleaning method in which chemicals are added to the water within the well casing to assist in dissolving the encrustations and mineral deposits which block the well casing openings, and in which a dc voltage of one polarity is applied to the water within the casing and a voltage of the opposite polarity is applied to the casing which produces an electrolytic action to accelerate the breakdown and dissolving of the encrustations. Another objective is to provide such a method in which the apparatus for carrying out the method is lightweight and portable and can be transported easily to the well site without requiring any vehicle which heretofore would damage the surrounding lawns and shrubbery of the well owner, and which apparatus requires only a 115-volt ac source of power for its operation.

A further objective is to provide a method and cleaning system which does not require removal of the existing delivery pipe and submersible pump from within the well casing, and in which no equipment or apparatus is lowered into the well casing for creating the pulsating action except for a water level sensor which is formed of flexible wires having sensing points spaced therealong at predetermined intervals. Another objective is to provide such a method and system in which the vacuum-producing apparatus is initiated manually or automatically upon the water level reaching a predetermined position at the bottom of the well casing for reversing the flow of the water upwardly within the casing where the water column upon reaching a predetermined height will automatically operate a venting valve for destruction of the vacuum on the well casing, enabling the water column to move downwardly within the well casing and outwardly through the inlet openings and into the surrounding strata.

Still another objective is to provide such a method and apparatus therefor in which the apparatus is formed of readily available components, eliminating any special and expensive equipment, which components can be mounted within a carrying case for easy storage and transportation to the well site. Another objective is to provide such a method in which the water in the casing which is continuously raised and lowered is periodically discharged from the casing to remove the deposits collected therein and is replaced with fresh water which flows into the casing from the surrounding strata. A further objective of the invention is to provide such an improved method and apparatus which eliminates difficulties existing in the art, solves problems, satisfies needs and obtains new results not believed possible with known well cleaning methods and apparatus.

These objectives and advantages are obtained by the improved method of cleaning a well, the general nature of which may be stated as including the steps of sealing the well casing to form a generally airtight enclosure therein; forming a vacuum within the well casing enclosure by pumping the air therefrom to raise a column of water within the well casing enclosure to a predetermined height; destroying the vacuum formed in the well casing enclosure causing the raised water column to drop downwardly forcing the water out through inlet openings adjacent the bottom of the well casing and into the surrounding strata to remove encrustations and obstructions blocking the inlet openings; and repeating the raising and lowering of the column of water in the well casing enclosure by creating a vacuum therein and destroying the same to clean the well casing openings and surrounding strata.

These objectives and advantages are obtained further by the apparatus for cleaning a well, the general nature of which may be stated as including means for sealing the upper end of a well casing for forming a generally airtight enclosure therein; water level sensing means located within the well casing for indicating the level of a water column in the casing enclosure; pump means communicating with the well casing enclosure for removing the air therefrom to form a vacuum to raise the level of the water column in the casing enclosure; means for destroying the vacuum upon the water reaching a predetermined height in the casing enclosure, whereupon the water column will descend and the water will flow outwardly through water inlet openings at the bottom of the well casing for unblocking said openings; and means for actuating the pump means upon the water column dropping to a predetermined lower level for creating another vacuum in the casing enclosure to raise the water column by drawing water into the casing through the inlet openings from the surrounding strata to further unblock said openings and rejuvenate the surrounding strata.

BRIEF DESCRIPTION OF THE DRAWINGS

A preferred embodiment of the invention, illustrative of the best mode in which applicant has contemplated applying the principles, is set forth in the following description and shown in the drawings and is particularly and distinctly pointed out and set forth in the appended claims.

Similar numerals refer to similar parts throughout the drawings.

DESCRIPTION OF THE PREFERRED EMBODIMENT

Figure 1:
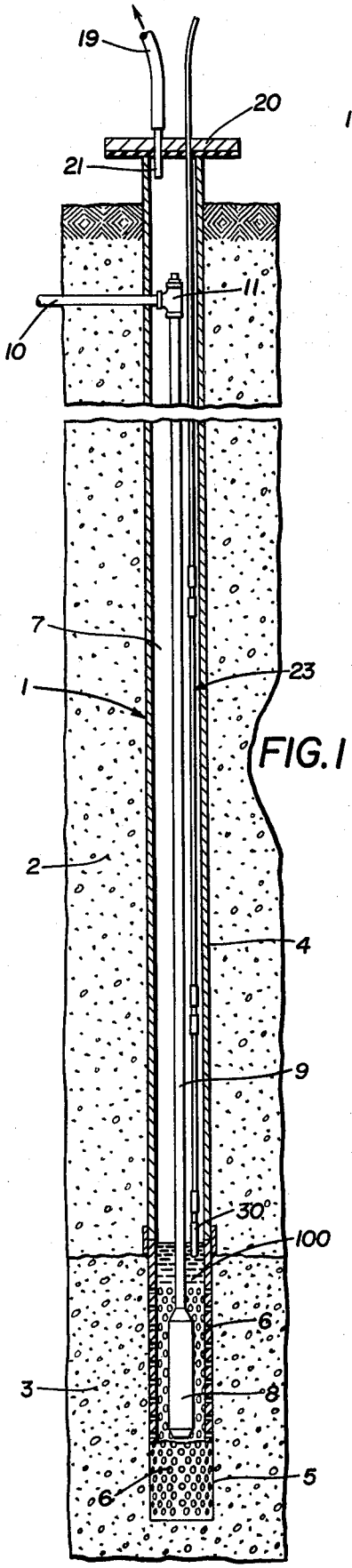
FIG. 1 of the drawings is a diagrammatic sectional view of a usual water well system with the water level sensor means located within the well and the top end of the well casing sealed, and with the water level at its static position prior to creating the pulsating action at the bottom of the well casing.

Referring to FIG. 1, a usual water well is shown therein which consists of a drill hole or shaft 1 which extends downwardly into the ground 2 for a predetermined distance required to reach water-bearing gravel or strata 3. A plurality of well casing sections 4 extend throughout shaft 1 with a bottom section 5 being formed with a plurality of openings 6 through which the water will flow into the interior 7 of the well casing. Bottom section 5 may be formed of the same rigid material as are the upper casing sections 4 or may be of a different construction providing a screen or strainer effect for admitting water from strata 3 into casing interior 7.

A usual submersible pump 8 is located within bottom casing section 5 and is mounted on the bottom end of a water delivery pipe 9 which extends throughout the length of the casing. Pipe 9 is connected at the upper end of the casing to a lateral takeoff line 10 by a coupler 11. Takeoff line 10 terminates within a residence or dwelling and is connected to a pressure tank located therein for supplying water to the residence. Pump 8 is connected to a source of electrical power by a power line (not shown) which extends along delivery pipe 9 in the usual manner of most well installations.

The apparatus for carrying out the improved method of cleaning a well is indicated generally at 15 (FIG. 4) and includes a portable carrying case 16 in which the various electrical circuitry and vacuum-producing components are contained. A blanking or storage tank 17 is shown connected to the equipment within carrying case 16 by an air line 18. Tank 17 is shown as a cylindrical type tank but can be formed of an enclosed flexible or rigid member which is located within case 16 to eliminate any exterior and additional component, if desired. Tank 17 is shown exteriorly located for illustrative purposes to more fully explain the apparatus of the invention.

The vacuum-producing apparatus within carrying case 16 is connected to the interior 7 of the well casing by an air line 19. Line 19 terminates in a rigid end 21 which extends through an opening formed in a resilient sealing pad 20 mounted on the top end of the uppermost casing section 4. End 21 terminates in the upper end of well casing enclosure 7, as shown in FIG. 1. Pad 20 provides an effective air seal for the upper end of the well casing to provide a generally airtight enclosure within the casing.

Figure 6:
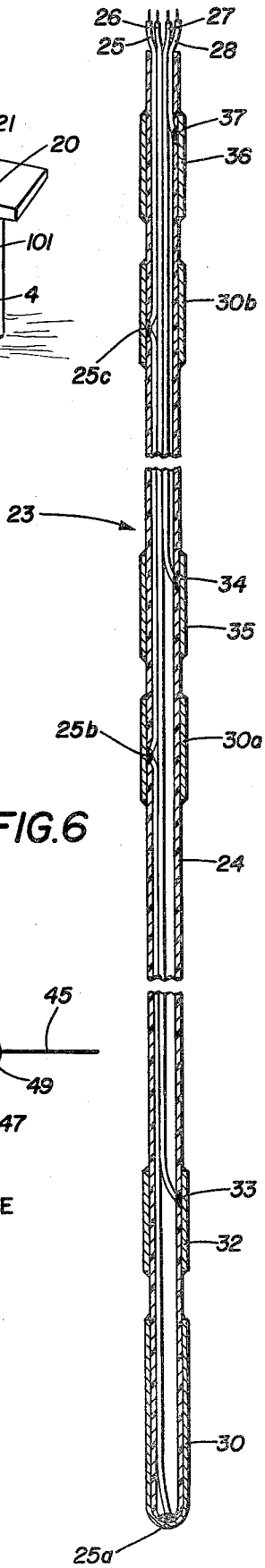
FIG. 6 is an enlarged, fragmentary sectional view of the water level sensing probe.

A water level sensing probe, indicated generally at 23, is inserted through another opening formed in sealing pad 20 and extends downwardly within casing interior 7 to the static water level, as shown in FIG. 1. Probe 23 includes an outer waterproof cover 24 (FIG. 6) in which four individually insulated electrical conductors 25, 26, 27 and 28 are contained. Conductor 25 extends completely throughout the length of cover 24 and terminates at its bottom end where it is connected by a solder connection **25*a* to a metal sleeve or electrical contact 30 which is attached to the outer portion of cover 24. Conductor 26 extends within cover 24 to a position closely adjacent contact 30 and is electrically connected to a second electrical contact 32 by soldered connection 33. Contact 32 preferably is a short section of metal sleeve which is secured to the outer surface of waterproof cover 24**.

Another metal sleeve or contact **30*a* is secured to the outer surface of cover 24 approximately five feet above contact 32 and is electrically connected to conductor 25 by a soldered connection 25*b*. Conductor 27 extends downwardly within cover 24 and terminates at a location immediately above contact 30*a* where it is connected by a soldered joint 34 to another contact 35. Contact 35 preferably is a metallic sleeve similar to contact sleeves 32 and 30*a*. Conductor 28 extends downwardly within cover 24 and terminates at a position approximately ten feet above metal sleeve 35 where it is connected to another metal sleeve contact 36 by a soldered connection 37. A third common contact sleeve 30*b* is mounted on cover 24 immediately below contact sleeve 36 and is electrically connected to conductor 25 by a soldered connection 25*c***.

Figure 5:
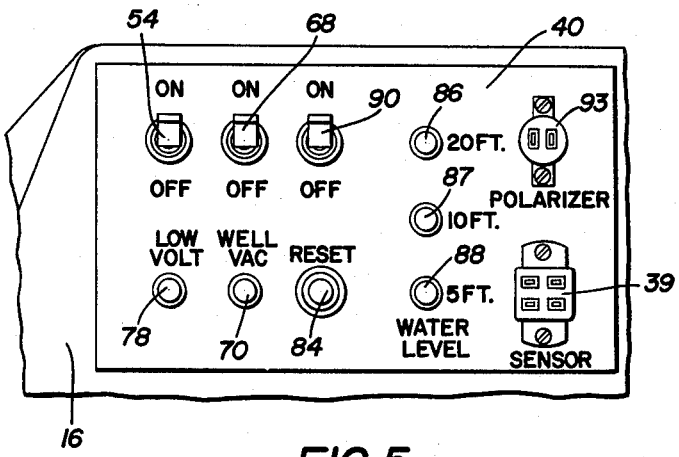
FIG. 5 is an enlarged front view of the control panel portion of the well cleaning apparatus shown in FIG. 4.

Conductors 25, 26, 27 and 28 and protective cover 24 terminate at an end plug 38 which is adapted to be received within a plug receptacle 39 (FIGS. 5 and 8) which is mounted on a control panel board 40 of carrying case 16. Conductors 25–28 in turn are connected to the appropriate control circuitry and water level signaling means through the internal wiring located within case 16, as described more fully below.

Figure 7:
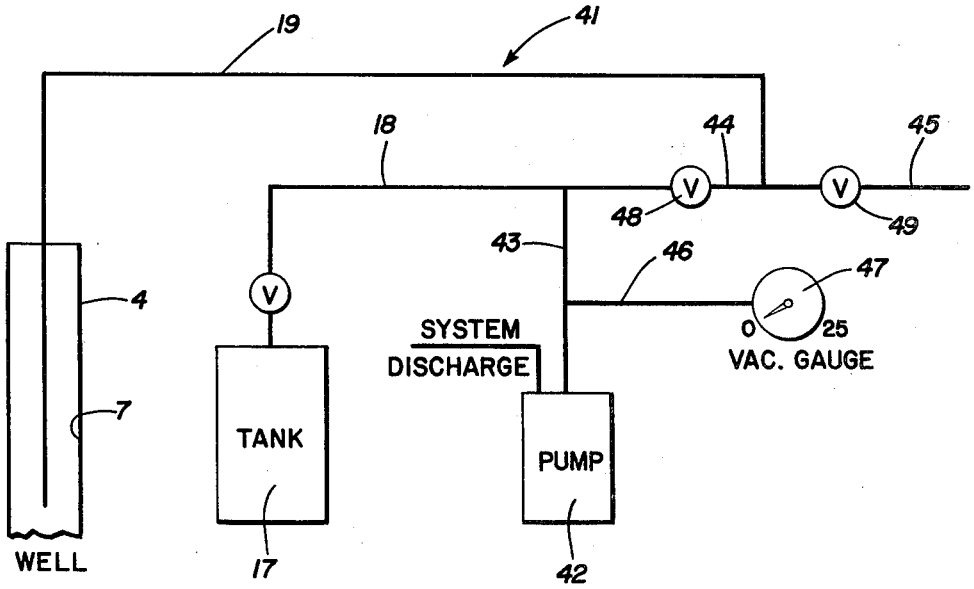
FIG. 7 is a diagrammatic block diagram of the air vacuum system.

Apparatus 15 further includes an air flow or vacuum-producing system, indicated generally at 41 and shown particularly in FIG. 7. Air system 41 includes blanking or storage tank 17 which is connected to a vacuum-producing pump 42 through lines 18 and 43. Air line 19 which communicates with casing interior 7 is connected to air lines 18 and 43 by an air line 44. Line 19 also is connected to a vacuum discharge line 45. Another air line 46 communicates with pump line 43 and a vacuum pressure-indicating gauge 47. Gauge 47 provides a visual indication to the operator of the equipment of the amount of vacuum in the system produced by pump 42 when the system is in the vacuum-producing mode. A pair of normally closed solenoid controlled valves 48 and 49 are operatively connected in air lines 44 and 45, respectively.

Figure 4:
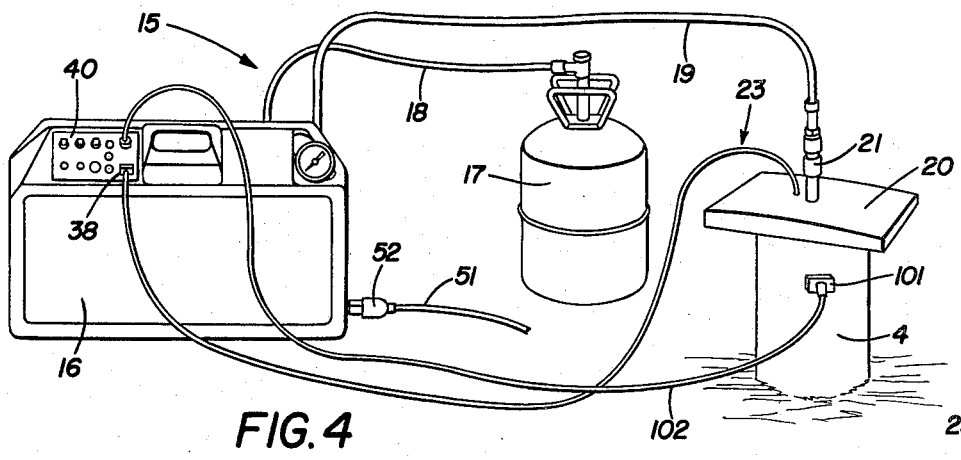
FIG. 4 is a diagrammatic perspective view of the top of a well with the well cleaning apparatus operatively connected thereto.
Figure 8:
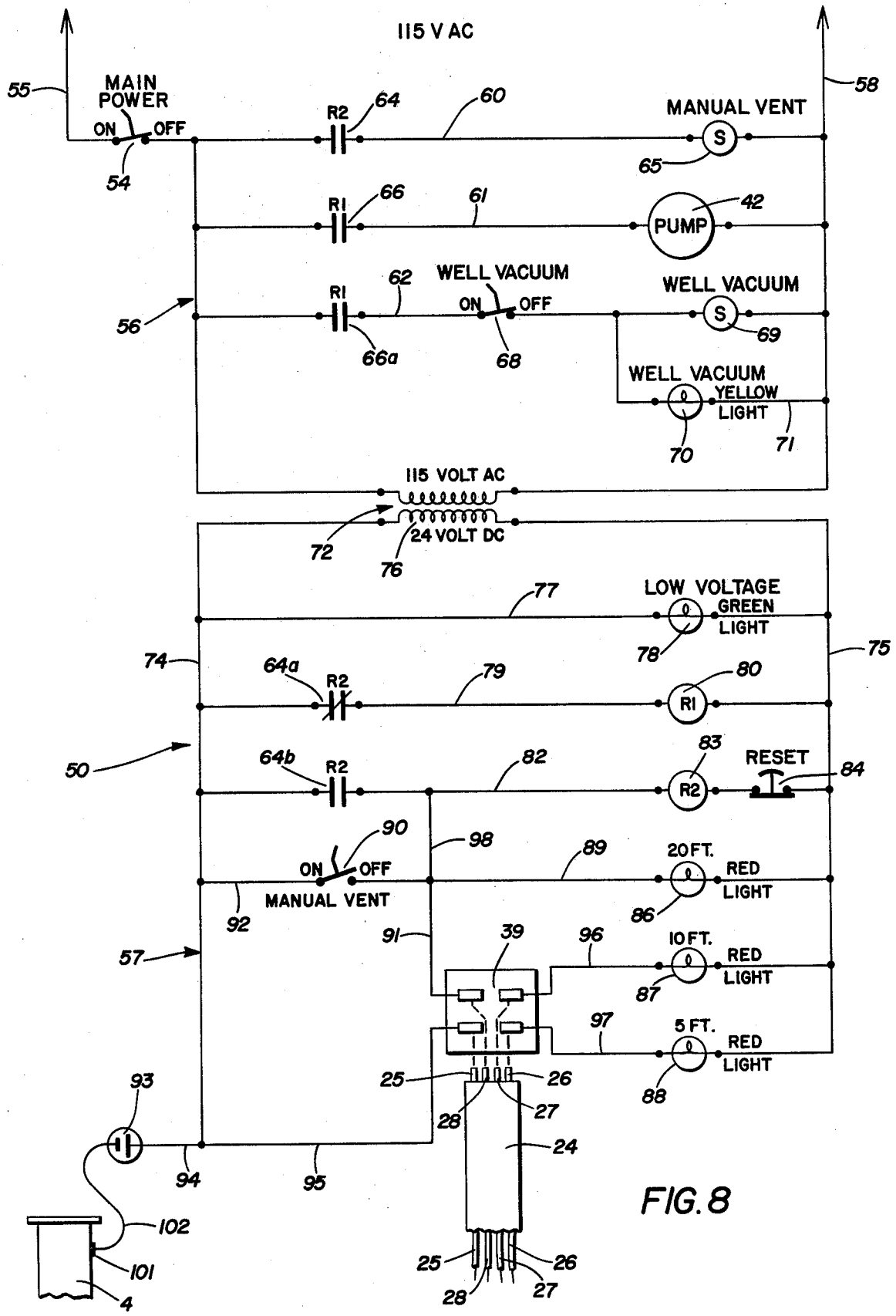
FIG. 8 is a schematic diagram of the electrical system of the improved well cleaning apparatus.

The electrical components and circuitry for the improved well cleaning apparatus are shown in FIG. 8 and indicated generally at 50. Circuitry 50 includes an ac circuit portion, indicated generally at 56, and a dc circuit portion, indicated generally at 57. Ac circuit portion 56 is adapted to be connected to a usual 115-volt ac power source by a usual electrical supply cord 51 which is connected to a receptacle mounted in the side of carrying case 16 by a plug 52 (FIG. 4). The other end of cord 51 (not shown) is adapted to be connected to a usual electrical outlet at the well owner's dwelling.

Ac circuit portion 56 includes main power supply lines 55 and 58 which are connected to branch lines 60, 61 and 62. Branch line 60 includes relay contacts 64 and a solenoid 65 which controls manual vent valve 49 located in air line 45 of air vacuum control system 41. Branch line 61 includes relay contacts 66 and vacuum-producing pump 42. Branch line 62 includes relay contacts **66*a*, a manually actuated switch 68 for controlling the well vacuum, and a solenoid 69 which controls well vacuum control valve 48 in air line 44. A well vacuum indicating light 70 is connected in a line 71 which is parallel with solenoid 69 to provide a visual indication to the operator when the system is in the vacuum-producing mode. A transformer 72 electrically connects ac circuit portion 56 with the dc portion 57 and provides the dc voltage for circuit portion 57. Transformer 72** is indicated as having a 115-volt ac/24-volt dc ratio.

Dc circuitry portion 57 includes a pair of main lines 74 and 75 connected to the terminals of dc winding 76 of transformer 72. A first branch line 77 extends between lines 74 and 75 and includes a low-voltage indicating light 78 which provides a visual indication on control panel 40 that the dc power supply is energized and functioning properly. A second branch line 79 extends between lines 74 and 75 and contains normally closed relay contacts **64*a* and a relay 80. Relay 80 controls contacts 66 and 66***a* in a manner described below. A third branch line 82 extends between lines 74 and 75 and contains a normally open relay contacts 64*b*, a relay 83 and a manually operated reset button or switch 84. Relay 83 controls contacts 64, 64*a* and 64*b*.

Three water level indicating lights 86, 87 and 88 are connected to main dc supply line 75 and to plug receptacle 39 for actuation by water level sensing probe 23. Light 86 is connected to plug receptacle 39 by lines 89 and 91, and lights 87 and 88 are connected to receptacle 39 by lines 96 and 97, respectively. A manually actuated on-off switch 90 is located in a branch line 92 which is connected across dc supply line 74 and to the junction of lines 91 and 98. Switch 90 provides a manual vent control for the air-vacuum system. A polarizing plug 93 is connected to line 74 by a line 94 which also is connected to the water level sensing plug 39 by a line 95.

The operation of the improved well cleaning apparatus and the particular steps of the improved cleaning method are described below. The well cleaning operator need only carry case 16, tank 17 and the associated equipment contained therein to a job site, which for most dwellings will be in an outside area closely adjacent to the dwelling. The top end of exposed well casing section 4 will have its top cap or cover removed unless the cap has vent openings formed therein. Sealing pad 20 (FIGS. 1 and 4) which preferably is a large pad of resilient rubberlike material, is placed over the top opening of casing section 4 for sealing the same. When a vacuum is produced in casing enclosure 7, the pressure differential will draw pad 20 tightly against the top of the casing section to form an airtight seal. The operator next inserts air line end 21 through pad 20 and, if necessary, seals about end 21 with putty or the like.

The apparatus then is connected to a 115-volt ac supply by cord 51 and the main power switch 54 is placed in the ON position. The dc circuitry 57 is energized through transformer 72 which activates low-voltage indicating light 78. Normally closed relay contacts 64*a* in line 79 enable relay 80 to be energized which closes relay contacts 66 in line 61 energizing pump 42. Relay 80 upon being energized also will close contacts 66*a*. Pump 42 will begin blanking or creating a vauum in storage tank 17 and air lines 18, 43 and 46 until gauge 47 indicates that the desired vacuum has been obtained in these compnents. Solenoid valves 48 and 49 will isolate storage tank 17 and connected lines from the remainder of the air vacuum system 41. This blanking operation eliminates the need for system lines 18, 43 and 46 being purged at the start of each vacuum operation, described more fully below. Also, this initial blanking operation will detect any air leaks in that portion of the air vacuum system.

After the blanking operation has been completed, water level sensing probe 23 is inserted through another opening in sealing pad 20 and lowered into well casing 4 until indicating light 88 is energized. When contact 30 at the bottom of probe 23 and adjacent contact sleeve 32 are covered with water at the bottom of the well casing, a circuit is completed through the water between contacts 30 and 32 simulating the closing of a switch between the respectively connected wires 25 and 26 (FIG. 8). This energizes light 88 through lines 95 and 97. After light 88 is energized, sensor 23 is pulled manually upwardly approximately five feet, and the opening in pad 20 through which it extends is sealed with putty or other sealing compound. Light 88 will go off as soon as contact sleeve 32 is pulled upwardly out of the well water.

Figure 2:
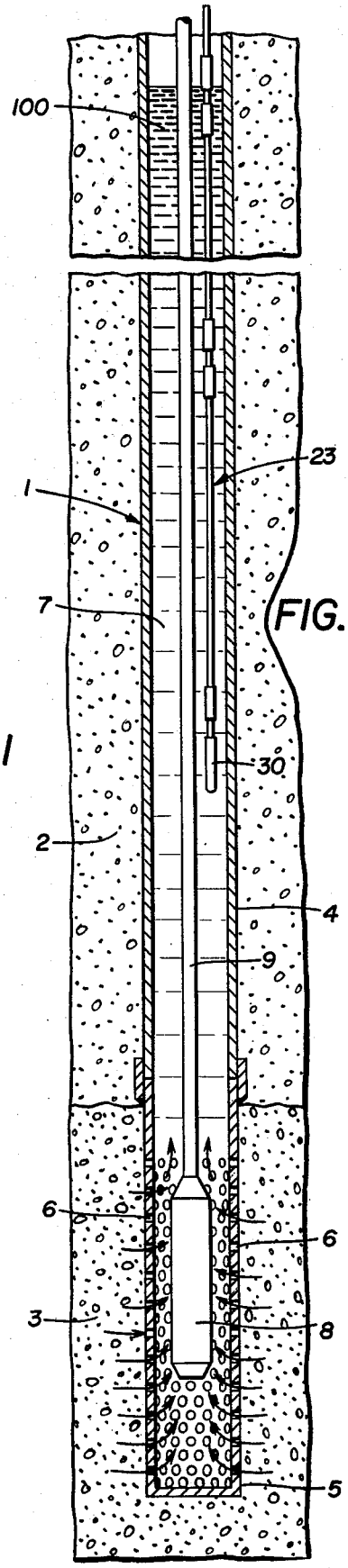
FIG. 2 is an enlarged, fragmentary diagrammatic sectional view of the lower portion of FIG. 1 showing the column of water in the casing at a raised position by the creation of a vacuum in the casing.

Well vacuum switch 68 then is moved manually to the ON position, which actuates solenoid 69 in line 61 which opens valve 48 in air line 44. Light 70 also comes on when switch 68 is closed, indicating to the operator that the system is in the vacuum-producing mode. Upon valve 48 opening, pump 42 begins drawing a vacuum in well casing 7 through air lines 19, 44 and 43. As the vacuum increases in well casing 7, it will cause the water column, indicated at 100, to begin rising from its static, at-rest position of FIG. 1 to a raised position, as shown in FIG. 2. The rising water column will energize lights 88, 87 and 86 as the water level reaches contacts 32, 35 and 36, respectively. The water completes the circuit between each of these respective contacts and contact sleeves 30*a* and 30*b*. Referring to FIG. 8, the water will complete the circuit between common line 95 and lines 97, 96 and 91 of lights 88, 87 and 86, respectively. Theoretically, by reducing the well casing enclosure to zero pressure (total vacuum), water column 100 will rise approximately thirty-four feet.

Upon water column 100 reaching contact 36 (FIG. 2) and completing the circuit between lines 95 and 91, relay 83 is energized through lines 91, 98 and 82, which opens contacts 64*a* in line 79 and closes contacts 64*b* in line 82. Opening of contacts 64*a* will deenergize relay 80 which opens contacts 66 and 66*a*, automatically deenergizing pump 42, and will close air valve 48 in line 44 and deenergizes well vacuum indicating light 70. Contacts 64*b* when closed will become locked in the closed position. When relay 83 is energized, it also will close contacts 64 in line 60, which actuates manual vent solenoid 65 which opens air valve 49 in air line 45. Opening of valve 49 connects well casing enclosure 7 to the surrounding atmosphere through air lines 19 and 45, which destroys the vacuum in the casing interior.

Although the above-described sequence of operation involves some details to describe, in actual practice the vacuum produced in the well casing that causes water column 100 to rise to its level of engagement with sleeve contact 36 on probe 23 will be destroyed immediately upon the water column contacting contact 36. The water column will begin to descend immediately from the position of FIG. 2 to that of FIG. 3 with the water being forced outwardly through inlet openings 6 and into and through the surrounding strata. This outward movement of the water will unblock openings 6 and rearrange the fine slit, sand and gravel surrounding the bottom casing section 5 as it moves into the surrounding strata.

As water column 100 drops, lights 87 and 88 will become deenergized and go out. Light 86 will remain energized, since contacts 64*b* in line 82 become locked in when energized, as described above. The operator can visually detect and determine the rate that the water column drops in the well casing enclosure 7 by the time required for light 87 and then light 88 to be deenergized. Upon light 88 being deenergized, the operator will know column 100 has reached its approximate static level. The system will remain in an inactive state until reset button 84 is depressed. When reset button 84 is depressed, relay 83 is momentarily deenergized which releases contacts 64*b* from the locked-in position. The system then is back to its initial or start condition and the above sequence is repeated for the creation and destruction of a vacuum.

Manual vent switch 90 in line 92 enables the vacuum to be destroyed before the water column reaches topmost contact 36. Closing of switch 90 completes a circuit through lines 74, 92, 98 and 82, which energizes relay 83 and closes contacts 64*b*, deenergizing relay 80 which opens contacts 66 and 66*a* to shut off pump 42 and which closes valve 48 and opens valve 49 to vent casing enclosure 7 to the surrounding atmosphere. The premature destruction of the vacuum by manual vent control switch 90 before water column 100 reaches its maximum raised position is desirable in that at the start of a well cleaning operation, excessive blockage of inlet openings 6 will require a considerable length of time for the water column to be raised to its maximum level. Therefore, it is desirable to raise the water column a certain distance, for example five or ten feet, and release the vacuum to begin the unblocking process. This type of action is repeated a number of times until the water column raising rate is increased. Thus, the operator can manually control the pulsating action applied at the bottom of the well by the use of manual vent switch 90 instead of requiring the water column to rise to its maximum position and engage contact 36.

It is desirable during the course of cleaning a well that water column 100 be discharged enabling fresh water to flow into well casing 7 and form a new column of clean, fresh water. This is accomplished by merely attaching a garden hose or the like to an outside faucet of the dwelling and pumping the water column from casing 7 by the well pump. After a predetermined quantity of water is discharged, which water will be dirty and cloudy due to the agitation at the lower end of the casing, the well pump is turned off, whereupon the new supply of water will enter through inlet openings 6 into casing 7 from the surrounding strata.

Another feature of the invention is the application of a polarizing or electrolytic action in the bottom of the well casing. This electrolytic action is achieved by connecting one side of the dc winding 24 to the metal well casing 4. A magnet 101 which is connected to the dc supply through a line 102 is plugged into polarizing plug 93, as shown in FIGS. 4 and 8. Thus, a dc voltage of one polarity is applied to the well casing, which creates the electrolytic action through the water in the casing to assist the destruction of the encrustations formed on the walls of the casing. This electrolytic action can be in effect during the entire cleaning operation without affecting the creation and desctruction of the internal vacuum and the pulsating action of the water at the inlet end of the casing.

In accordance with another feature of the invention, a chemical solution such as chlorine which will assist in the breakdown of mineral deposits and encrustations in water well systems, can be poured into casing enclosure 7 at the start of the cleaning operation. This chemical will accelerate the cleaning and unblocking of the inlet openings and surrounding strata. Additional chemicals can be placed into enclosure 7 after the water column is replaced with a fresh supply of water, as described above. Again, the introduction of the chemical assists the cleaning operation but is not required to achieve the main cleaning results which are achieved by the pulsating action at the lower end of the casing.

Thus, broadly summarizing the particular method steps of the invention, a well cleaning operator seals the top of the well casing by placing pad 20 on the open top thereof which forms a generally airtight enclosure therein. Next, a vacuum is formed within the well casing enclosure by removing the air therefrom by pump 42, which raises water column 100 within the well casing enclosure to a predetermined height. Upon the water column reaching the predetermined height, the vacuum is destroyed either by manual actuation of vent switch 90 or automatic destruction upon the water column reaching contact 36. Destruction of the vacuum causes the raised water column to drop downwardly, which forces the water out through inlet openings 6 adjacent the bottom of the well casing and into the surrounding strata. This outward surging of the water removes the encrustations and obstructions blocking the inlet openings and also will flow through the strata removing and repositioning the fine silt and sand therein to enhance the flow of water into the well casing. This raising and lowering of the water column is repeated over a sufficient period of time until the water column rises rapidly, which indicates to the operator that the inlet openings in the casing are unblocked.

Figure 3:
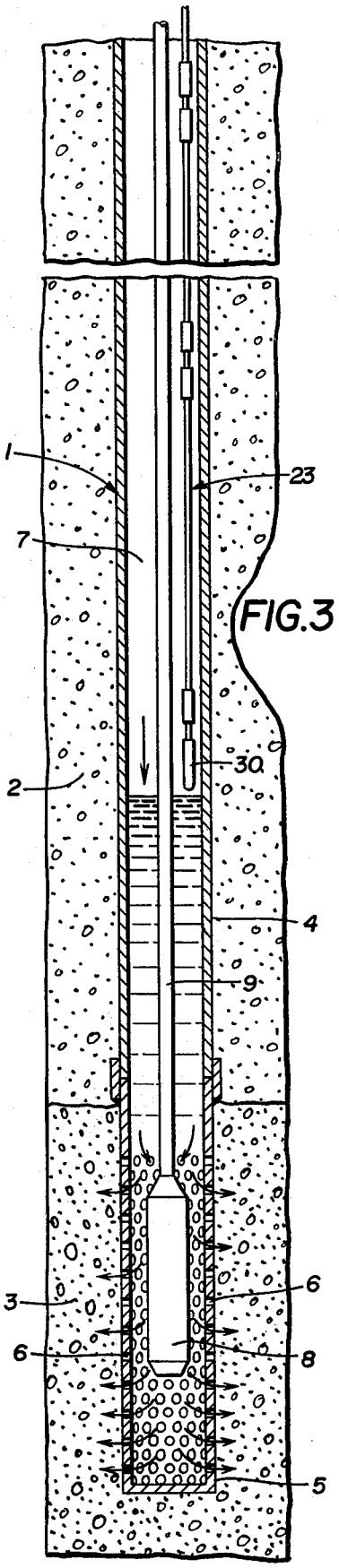
FIG. 3 is a view similar to FIG. 2 showing the outward surging of the water column upon the release of the vacuum on the well casing.

FIG. 1 shows the condition of the well at the start of the improved cleaning method in which sensor 23 is at the level of the static water column, with FIG. 2 depicting the method during the vacuum-forming step, wherein the water flows into casing enclosure 7 through lower openings 6 and the water column is raised therein until it reaches sensor contact 36. Sensor 23 is shown in its manually raised position in FIGS. 2 and 3. FIG. 3 depicts the particular phase of the cleaning method wherein the vacuum has been destroyed and the water column is dropping in casing enclosure 7 with the water being forced outwardly through casing openings 6 and into the surrounding strata.

After cleaning a number of wells, an operator will develop a "feel" for the cleaning process taking place in the casing below by the amount of time required for the vacuum to raise the water column within the casing. The greater the blockage of the inlet openings and surrounding strata, the longer will be the time required to raise the column of water to the maximum height. Therefore, by manipulating the manual vent ON and OFF switch 90, an initial pulsating action can be created to eliminate much of the blocking before the automatic vacuum destruction mode is used. Indicating lights 86, 87 and 88 enable the operator to visually see the rate that the water column is rising and lowering within casing 7.

The initial vacuum blanking of the system increases the speed at which the vacuum is applied directly on casing enclosure 7 without requiring the various air lines and components of the apparatus to be purged at the start of each vacuum-producing mode. The blanking operation also can assist in detecting leaks in the system.

The improved system also enables the use of various chemicals to be used in the cleaning operation without affecting the basics thereof, which is desirable in certain wells depending upon the type of minerals which may be encountered. Also, an electrolytic action can be created, further assisting in the destruction of the mineral deposit build ups on the well casing and inlet openings.

One of the main features of the improved method and the apparatus is that water delivery pipe 9 and submersible pump 8 need not be removed or altered in order to carry out the cleaning operation. Also, no large and bulky equipment is required to be placed in the well or brought to the well site, as in prior cleaning systems. The only equipment that is placed in the well is sensor 23 which is a bundle of flexible wires in a waterproof cover which can be easily stored on a reel or similar device for transportation to and from a job site. As can be seen from FIG. 4, the amount of equipment required and the size thereof is extremely small and lightweight and can be easily transported by a single operator to and from the job site in a pickup truck or other small vehicle.

Accordingly, the improved method and apparatus are simplified, provide effective, safe, inexpensive, and efficient means for achieving all the enumerated objectives, provide for eliminating difficulties encountered with prior methods and apparatus, and solve problems and obtain new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the method of cleaning a well and apparatus therefor is performed and used, the characteristics of the method and apparatus, and the advantageous, new and useful results obtained; the new and useful structures, devices, elements, arrangements, parts, and combinations, method steps and procedures, are set forth in the appended claims.

I claim:

1. An improved method of cleaning a well including the steps of:

(a) sealing the well casing to form a generally airtight enclosure therein;

(b) forming a vacuum within the well casing enclosure by pumping the air therefrom to raise a column of water within the well casing enclosure to a predetermined height;

(c) destroying the vacuum formed in the well casing enclosure causing the raised water column to drop downwardly forcing the water out through inlet openings adjacent the bottom of the well casing and into the surrounding strata to remove encrustations and obstructions blocking the inlet openings; and (d) repeating the raising and lowering of the column of water in the well casing enclosure by creating a vacuum therein and destroying the same to clean the well casing openings and surrounding strata.

2. The method defined in claim 1 including the steps of placing a chemical solution in the water in the well casing enclosure to assist the destruction of encrustations on the well casing.

3. The method defined in claim 2 in which the chemical solution is chlorine.

4. The method defined in claim 1 including the step of inserting water level indicating means into the well casing enclosure to detect the level of the water column therein.

5. The method defined in claim 4 in which the water level indicating means provides a series of visual signals, each signal indicating a different height of the water column in the well casing enclosure.

6. The method defined in claim 5 in which the water level indicating means is initially lowered to the static level of the water column and then raised to a predetermined position above said static level before forming the vacuum within the casing enclosure.

7. The method defined in claim 1 including the step of applying a dc voltage of a certain polarity to the well casing to create an electrolytic action for accelerating the breakdown of encrustations on the well casing.

8. The method defined in claim 1 including the steps of providing a storage tank communicating with portions of the vacuum-forming apparatus; and creating a vacuum in the storage tank at the start of a well cleaning operation and maintaining said vacuum in the tank throughout the cleaning operation.

9. The method defined in claim 1 in which the vacuum within the well casing enclosure is destroyed automatically upon the water column reaching a predetermined height in the casing by actuating an electrical circuit which operates a valve to vent the well casing enclosure to the atmosphere.

10. The method defined in claim 1 including the step of periodically removing the water column from a portion of the well casing enclosure and providing a fresh column of water in the casing enclosure from the surrounding strata.

11. A system for rejuvenating a well including:

(a) means for sealing the upper end of a well casing for forming a generally airtight enclosure therein;

(b) water level sensing means located within the well casing for indicating the level of a water column in the casing enclosure;

(c) pump means communicating with the well casing enclosure for removing the air therefrom to form a vacuum to raise the level of the water column in the casing enclosure;

(d) means for destroying the vacuum upon the water reaching a predetermined height in the casing enclosure, whereupon the water column will descend and the water will flow outwardly through water inlet openings at the bottom of the well casing for unblocking said openings; and (e) means for actuating the pump means upon the water column dropping to a predetermined lower level for creating another vacuum in the casing enclosure to raise the water column by drawing water into the casing through the inlet openings from the surrounding strata to further unblock said openings and rejuvenate the surrounding strata.

12. The system defined in claim 11 in which the water level sensing means includes a plurality of electrical conductors extending downwardly into the well casing enclosure with certain of said conductors being connected to separate contactors located at spaced intervals along the casing enclosure whereby the water will complete an electrical path between certain of the contactors upon the water level reaching said certain contactors.

13. The system defined in claim 11 in which auxiliary storage chamber means communicates with the pump means for forming a vacuum in said chamber means prior to forming a vacuum in the casing enclosure to check for air leaks and assist the sealing means on the upper end of the casing to form a generally airtight enclosure in the well casing.

14. The system defined in claim 11 in which one terminal of a dc power supply is connected to an electrode which is connected to the well casing to create an electrolytic action to assist in decomposing encrustations formed on the well casing.

15. The system defined in claim 11 in which pressure indicating means communicates with the pump means and well casing enclosure to provide a visual reading of the pressure in the casing enclosure.

16. The system defined in claim 11 in which the pump means is connected to the well casing enclosure by an air line; in which first solenoid-activated valve means is connected to the air line for opening and closing said air line; and in which the first valve means is in an open position when a vacuum is formed in the well casing enclosure.

17. The system defined in claim 16 in which the means for destroying the vacuum includes a vent line communicating with well casing enclosure and the atmosphere, and a second solenoid-actuated valve means for opening and closing said vent line; and in which the second valve means is moved to an open position to vent the well casing enclosure to the atmosphere to destroy the vacuum.

18. The system defined in claim 11 in which the sealing means is a pad of resilient material adapted to be placed on an open top of the well casing.

* * * * *